United States Patent [19]

DeBlock et al.

[11] Patent Number: 4,884,376

[45] Date of Patent: Dec. 5, 1989

[54] SUN PORCH

[75] Inventors: David A. DeBlock; Kert E. Artwick, both of Holland, Mich.

[73] Assignee: ODL, Incorporated, Zeeland, Mich.

[21] Appl. No.: 107,796

[22] Filed: Oct. 13, 1987

[51] Int. Cl.[4] ..... E04B 7/04

[52] U.S. Cl. ..... 52/90; 52/92; 52/295; 52/463; 52/467

[58] Field of Search ..... 52/282, 96, 398, 399, 52/93, 463, 467, 281, 92, 90, 295

[56] References Cited

U.S. PATENT DOCUMENTS

| | | | |
|---|---|---|---|
| 1,921,303 | 8/1933 | Raschka . | |
| 2,377,788 | 6/1945 | King . | |
| 2,653,553 | 9/1953 | Jacobs . | |
| 2,784,814 | 3/1957 | Bright . | |
| 2,803,856 | 8/1957 | Kofahl et al. . | |
| 3,037,591 | 6/1962 | Pulling | 52/397 |
| 3,066,770 | 12/1962 | Millard et al. . | |
| 3,068,970 | 12/1962 | Neal . | |
| 3,113,401 | 12/1963 | Rose | 52/284 |
| 3,148,479 | 9/1964 | D'amato . | |
| 3,150,463 | 9/1964 | Nearing et al. . | |
| 3,236,014 | 2/1966 | Edgar . | |
| 3,397,496 | 8/1968 | Sohns . | |
| 3,436,885 | 4/1969 | Rothermel . | |
| 3,529,389 | 9/1970 | Wilkins | 52/281 |
| 3,529,394 | 9/1970 | Wilkins | 52/282 |
| 3,562,972 | 2/1971 | D'amato . | |
| 3,641,720 | 2/1972 | Berrie . | |
| 3,678,625 | 7/1972 | Vance . | |
| 3,685,241 | 8/1972 | Cooper | 52/286 |
| 3,719,016 | 3/1973 | Randolph . | |
| 3,738,083 | 6/1973 | Shimano . | |
| 3,751,865 | 8/1973 | Brigham . | |
| 3,758,997 | 9/1973 | Vance . | |
| 3,782,048 | 1/1974 | Corman . | |
| 3,885,361 | 5/1975 | De Schutter . | |
| 3,987,597 | 10/1976 | Smrt . | |
| 3,999,353 | 12/1976 | Dielman . | |
| 4,006,573 | 2/1977 | Biebuyck . | |
| 4,057,941 | 11/1977 | Schwartz . | |
| 4,068,421 | 1/1978 | Marovich . | |
| 4,069,627 | 1/1978 | Pegg . | |
| 4,086,734 | 5/1978 | Hayashi . | |
| 4,103,463 | 8/1978 | Dixon . | |
| 4,316,405 | 2/1982 | Esposito . | |
| 4,335,547 | 6/1982 | Maxwell . | |
| 4,391,069 | 7/1983 | Vermillion . | |
| 4,418,506 | 12/1983 | Weber | 52/235 |
| 4,438,680 | 3/1984 | Esposito . | |
| 4,478,013 | 10/1984 | Tavano . | |
| 4,524,112 | 6/1985 | Willert | 52/398 |
| 4,596,093 | 6/1986 | Esposito . | |
| 4,601,139 | 7/1986 | Esposito . | |
| 4,612,744 | 9/1986 | Shamash . | |
| 4,756,127 | 7/1988 | Helterbrand | 52/397 |

*Primary Examiner*—John E. Murtagh

*Attorney, Agent, or Firm*—Warner, Norcross & Judd

[57] ABSTRACT

The specification discloses a modular sun porch which can be easily and quickly assembled. The wall assembly includes a plurality of identical modular window panels whose lateral edges interfit in male/female relationship to provide weather seals therebetween. Modular door units, which have a width equal to one or more window panels, can be substituted for the window panels in the wall assembly and include frames which interfit with the male/female scheme. The base for the wall assembly is levelable and hides both the base tie-downs and the leveling mechanism. The roof includes rafters and purlins which slide-lock into position between beams and rafters, respectively. Roof panels rest on gaskets carried by the rafters and purlins, and retainers are secured to the rafters to retain the panels in position and to improve the weather seal.

22 Claims, 8 Drawing Sheets

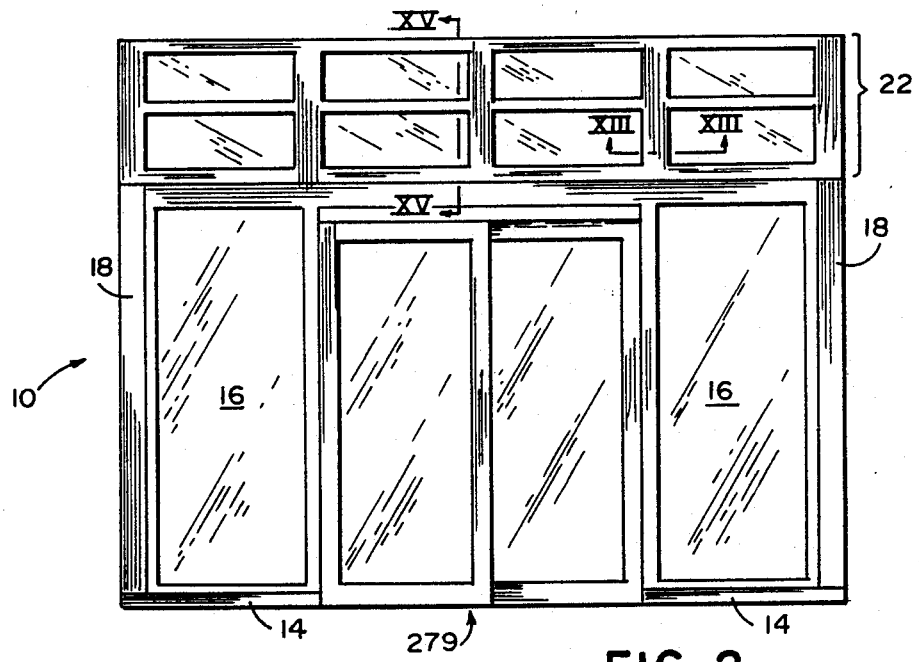
FIG. 2
FIG. 3A
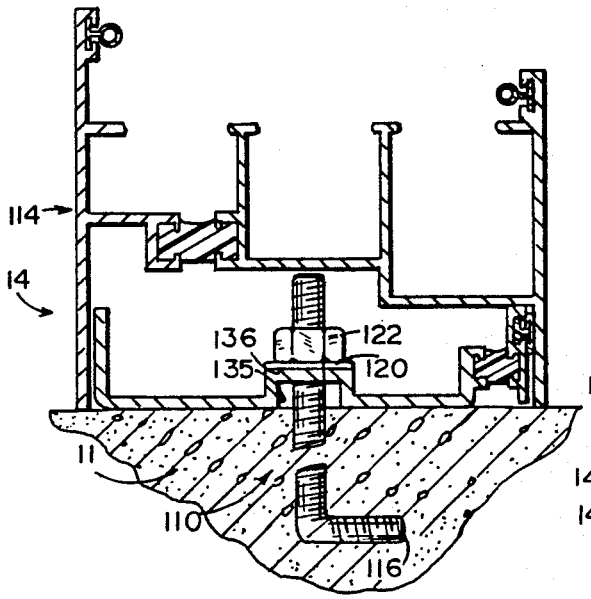
FIG. 3B
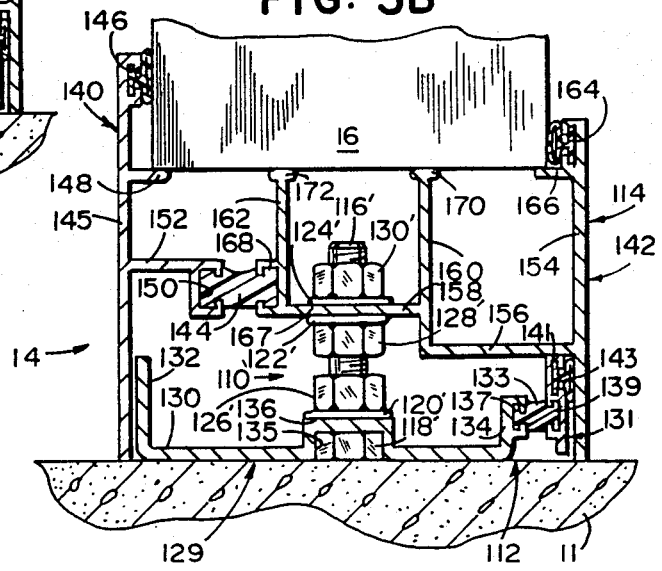

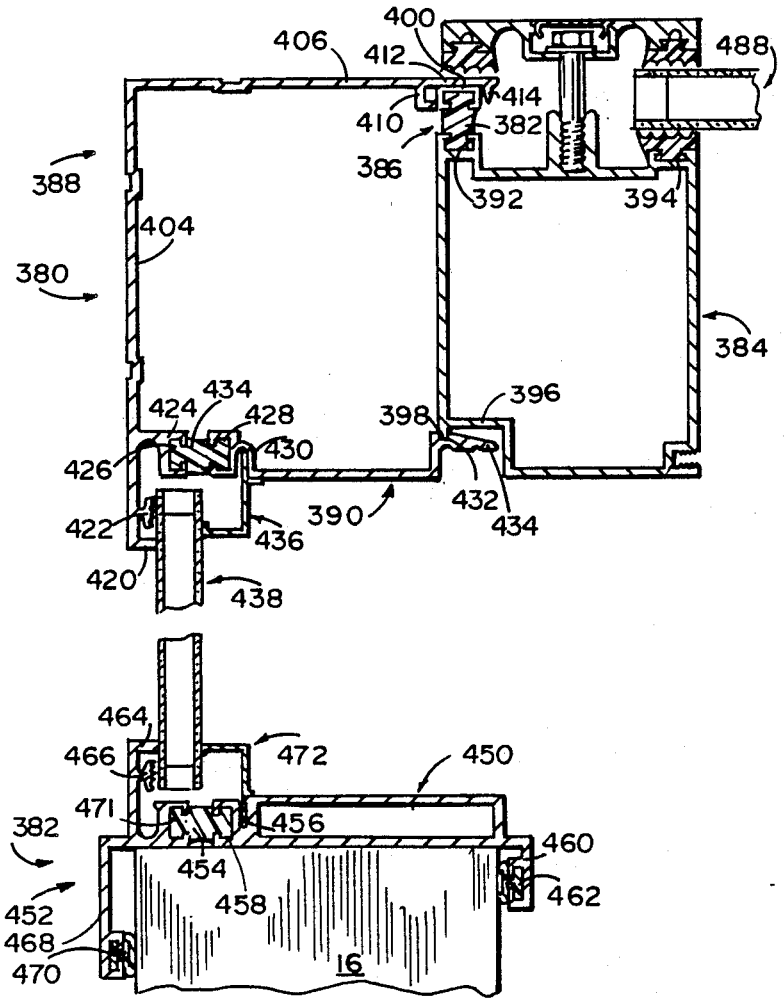
FIG. 11
FIG. 14
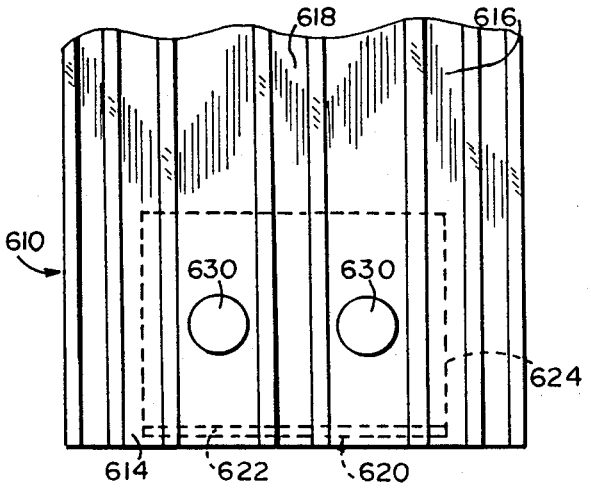

SUN PORCH

BACKGROUND OF THE INVENTION

The present invention relates to sun porches, which are ⇄greenhouse⇄-type units to be added on to an existing building structure.

Sun porches have gained increasing popularity as a means of expanding residential living space without significant structural changes. A sun porch is typically sold in kit form for assembly and installation by a skilled carpenter or other craftsman. However, known sun porches are not without their drawbacks. Most notably, constructions to date have been relatively complicated and required the skills of a carpenter or other skilled worker for installation of the unit. Consequently, assembly of known sun porches is relatively expensive and simply beyond the capabilities of many homeowners and other "do-it-yourselfers⇄.

SUMMARY OF THE INVENTION

The aforementioned problems are overcome in the present invention wherein a sun porch is provided which can be relatively easily and rapidly assembled and installed by homeowners and other "do-it-yourselfers⇄ having limited construction skills.

In a first aspect of the invention, the sun porch includes a wall assembly including a plurality of modular interfitting window panels. Each window panel includes a frame having opposite male and female side members. The side members of adjacent window panels interfit permitting easy assembly while still providing the requisite weather sealing therebetween. Preferably, the sun porch further includes corner posts for interconnecting two of the window panels at a corner. If included, the corner post includes a male portion for receiving the female side member of one window panel and a female portion for receiving the male side member of the other wall panel. Further preferably, the sun porch includes male and female wall rails to be mounted to the existing building structure and which interfit with female and male side members, respectively, on window panels to complete the modular scheme. The described construction greatly facilitates the assembly of the sun porch wall.

In a second aspect of the invention, the sun porch includes a novel base means for easily leveling the window panels. More specifically, the base includes an H-channel adjustably supported on threaded members anchored in the sun porch concrete floor. The downwardly depending legs of the H-channel hide the leveling mechanism; while the upwardly extending legs of the H-channel receive the lower edge of the modular wall panels. The H-channel further includes means for spacing the wall panels above the web portion of the H-channel to provide a clearance for the leveling/tie-down mechanism. Consequently, the base is both functional and aesthetically pleasing. The base can be fully and accurately leveled throughout its length, and yet the leveling mechanism is totally hidden within the assembled unit.

In a third aspect of the invention, a door assembly is provided which can be substituted for one or more of the window panels. In this embodiment, the window panels each have a generally uniform width and the door has a width which is a multiple of the window panel width. Further, the door frame includes male and female side frame members to interfit with the side frame members of the modular window panels. Consequently, the door can be easily substituted for one or more window panels in the sun porch wall to provide a means for ingress to and egress from the sun porch interior. This construction maintains the modularity of the sun porch wall assembly while still providing a means of access to the sun porch.

In a fourth aspect of the invention, a novel roof assembly is provided for easily and effectively sealing the roof panels within the supporting structure. Specifically, the roof assembly includes a plurality of rafters each having sealing means extending longitudinally along the upper surface thereof. A window panel is mounted between each pair of rafters, and the adjacent window panels on each rafter are spaced from one another. A retainer is provided having a length substantially identical to the rafter and including sealing means on its underside for engaging the window glass. Fasteners extend between the retainer and the rafter to secure the retainers in position and enhance the weather seal therebetween. The fastener means are located between the adjacent roof panels. The described construction is relatively simple, is easily assembled, and yet provides the requisite weather seal.

In a fifth aspect of the invention, the roof includes an easily assembled beam-and-rafter roof construction. Specifically, the roof assembly includes a pair of spaced beams each of which includes support members protruding therefrom toward the opposite beam. Each rafter extends between the two beams and includes a connector means which slides into engagement with the support means as the rafter is placed in position. The connector means on the rafter and the support means on the beam are both confined within the cross-sectional configuration of the rafter or its imaginary longitudinal extension. Consequently, the interconnecting structure is hidden from view in the assembled roof. Again, the structure facilitates assembly of the roof by permitting the rafters to be simply slid into position. Further, the construction provides an aesthetically pleasing appearance since the fastening mechanism is hidden from view.

These and other objects, advantages, and features of the invention will be more readily understood and appreciated by reference to the detailed description of the preferred embodiment and the drawings.

BRIEF DESCRIPTION OF THE DRAWINGS

FIG. 2 is a front elevational view of the sun porch;

FIG. 3A is a sectional view of the base showing the tie-down assembly taken along line III—III in FIG. 1;

FIG. 3B is a sectional view similar to FIG. 3A showing the height-adjustment assembly;

FIG. 11 is a fragmentary sectional view of the left triangle assembly taken along line XI—XI in FIG. 1;

FIG. 14 is a fragmentary top plan view of a purlin with the gaskets removed.

DETAILED DESCRIPTION OF THE PREFERRED EMBODIMENT

Figure 1:
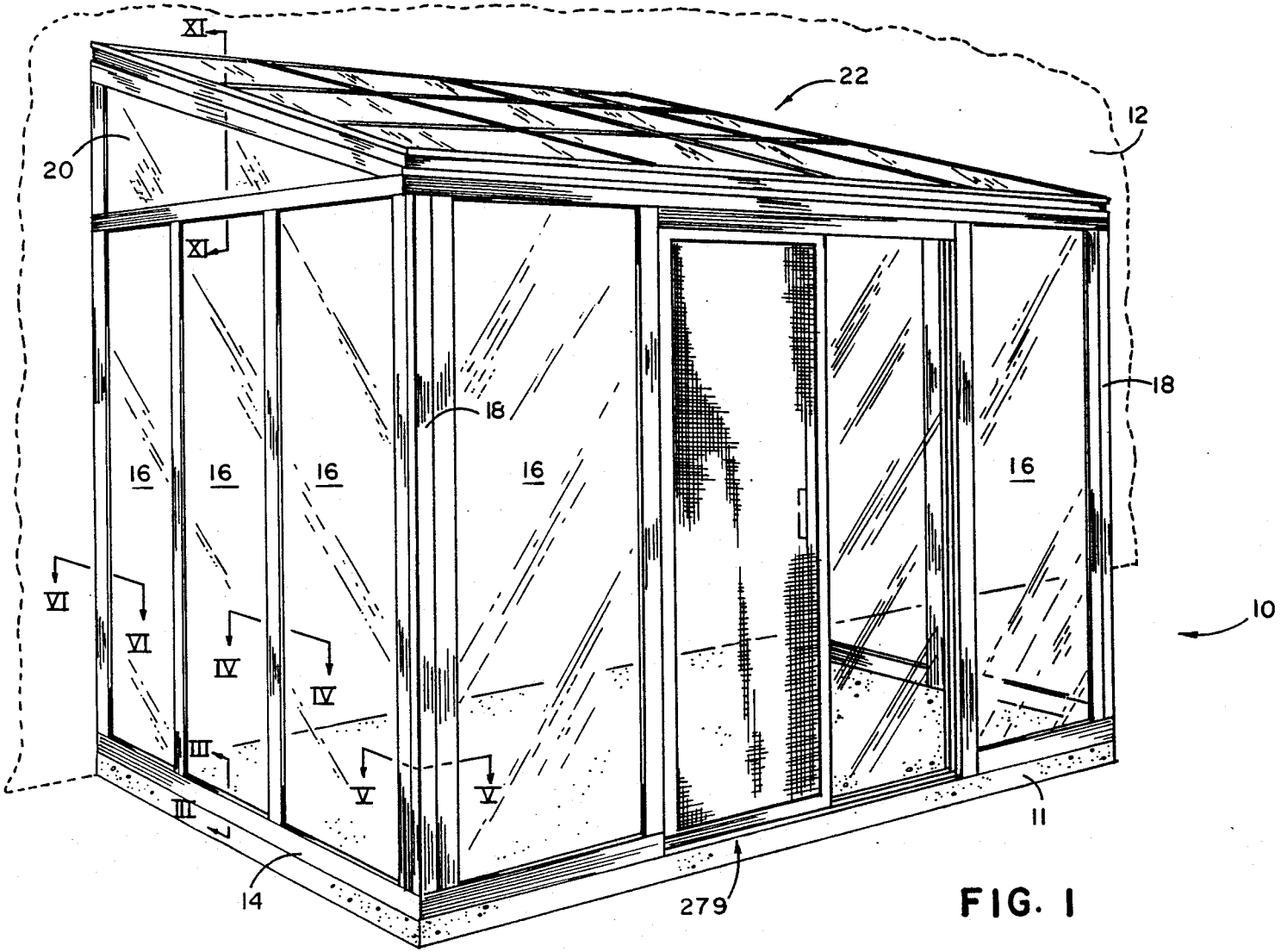
FIG. 1 is a perspective view of the present sun porch.

A sun porch constructed in accordance with a preferred embodiment of the invention is illustrated in FIGS. 1 and 2 and generally designated 10. The sun porch is shown mounted on a concrete pad or slab 11 and is attached to an existing building 12. The construction of the sun porch is generally modular including a base 14, a plurality of modular window panels 16, a pair of corner posts 18, a pair of triangles 20, and a roof assembly 22. The wall panels 16 are supported by the base 14 which is in turn anchored to the concrete pad 12. The triangles 20 and the roof assembly 22 provide a roof for the unit so that it is fully enclosed from the weather.

The term sun porch as used herein refers to a primarily glass enclosure adapted to be attached or connected to a building. Other names for these units are sun sheds and greenhouses.

I. Base

The base construction 14 (FIGS. 3A and 3B) supports the wall panels 16 above the concrete pad 11. The base includes a tie-down assembly 110, a C-channel 112, a height-adjustment assembly 110', and an H-channel 114. A plurality of the tie-down height-adjustment assemblies 110 and 110' are provided along the length of the base assembly 14, preferably on 30½-inch centers and alternating with each other so that one of the assemblies 110 or 110' are provided on 15¼-inch centers.

All extrusions illustrated and/or described in the present application are preferably fabricated of aluminum with urethane thermal breaks. The fabrication of such extrusions is generally well-known to those skilled in the extrusion art. Of course, suitable substitute materials could also be used.

The C-channel (FIG. 3B) is thermally broken extrusion including an exterior portion 129, an interior portion 131, and a thermal break 133. The exterior portion includes a web portion 130 which defines a channel 135 in its underside. One aperture 136 is formed in the floor of the groove 135 on each 15¼-inch center to receive either a tie-down assembly 110 or a height-adjustment assembly 110'. A pair of side flanges 132 and 134 extend upwardly from the opposite edges of the web portion 130; and the flange 134 defines a thermal-break channel 137. The exterior portion 131 defines a thermal-break channel 139 and a bulb-seal channel 141 on opposite sides thereof. The thermal break 133 fills both channels 137 and 139 to interconnect the two portions 129 and 131. A bulb seal 143 is supported within the channel 141 to provide a seal between the C-channel 112 and the H-channel 114. Preferably, butyl caulk or other appropriate glazing compound is placed between the pad 11 and the C-channel 112 prior to installation of the C-channel.

Each tie-down assembly 110 (FIG. 3A) includes an anchor bolt 116, a flat washer 120, and a hex nut 122. The anchor bolt 116 is embedded within the concrete pad 11 on 30½-inch centers preferably prior to setting of the concrete. Alternatively, the anchor bolt 116 can be installed subsequent to setting of the pad 11. The holes 136 in the C-channel 112 are aligned with the bolts 116 when the C-channel is placed thereover. The flat washer 120 and hex nut 122 are positioned on the bolt 116 and tightened against the channel 135 to secure the C-channel 112 against the pad.

Each height-adjustment assembly 110' (FIG. 3B) includes a hex bolt 116', flat washers 120', 122', and 124', and hex nuts 126', 128', and 130'. The bolt 116' extends upwardly through the aperture 136 in the C-channel 112 so that the head is received and locked within the channel 135. The flat washer 122' and the hex nut 126' are positioned on the bolt 116' and tightened against the C-channel 112 to secure the bolt in position. The height-adjustment hex nut 128' and the washer 122' are positioned on the bolt 116' so that all hex nuts 128' are horizontally level with one another. The H-channel is supported on the hex nuts 128' by fitting the holes 167 over the bolts 116'. Finally, the flat washer 124' and the tie-down hex nut 130' are tightened against the H-channel to secure the H-channel in its height-adjusted and horizontally level position.

The H-channel 114 (FIG. 3B) is supported by the height-adjustment assemblies 110. The H-channel is a thermally broken extrusion including an exterior portion 140, an interior portion 142, and a thermal break 144. The exterior portion 140 includes a generally planar outer wall 145 including, along its inner surface, an integral bulb-seal channel 146, a panel support flange 148, and a thermal-break channel 150 supported on a flange 152. The bulb-seal channel 146 is at the top or upper edge of the outer wall 145, while the panel support 148 is located therebelow.

The interior portion 142 (FIG. 3) includes an interior wall 154 and web flange 156, a support flange 158, and a pair of support flanges 160 and 162. The inner wall 154 defines an integral bulb-seal channel 164 and an integral panel support 166. The bulb-seal channel is located along the top or upper edge of the interior wall 142, while the panel support flange 166 is located therebelow. The web flange 156 is generally perpendicular to the inner wall 154 and generally coplanar with the support flange 152 of the exterior extrusion 140. One aperture 167 is formed in the web flange and aligned with each height-adjustment assembly 110. The first panel-support flange 160 extends upwardly from the junction of the web flange 156 and the support flange 158. The second panel support flange 162 extends upwardly from the terminal edge of the support flange 158. An integral thermal break channel 168 is located at the junction of the support flange 158 and the panel support flange 162. Both of the panel-support flanges 160 and 162 terminate in a broadened foot portion 170 and 172, respectively, to provide improved support for the panel 16. The panel supports 148, 166, 170, and 172 lie within a common horizontal plane to support the planar lower surface of the panel 16.

A thermal break 144 is interposed between the outer and inner portions 140 and 142 to provide thermal insulation therebetween. Specifically, the thermal break 144 fills both thermal-break channels 150 and 168 and spaces the two portions one from the other.

The wall panels 16 are supported within the base assembly 14 by sliding the wall panel between the outer and inner walls 144 and 154 and resting the wall panel on the supports 148, 166, 170, and 172. The lower portions of the outer wall 144 and the inner wall 154 extend downwardly over the walls 132 and 134, respectively, of the C-channel 112 to hide the C-channel in the completed assembly.

II. Wall Panels

The wall panels 16 (FIGS. 1, 2, and 4) are each generally identical to one another, having a uniform width, and therefore are modular or interchangeable in the sun porch construction. As seen more specifically in FIG. 4, each panel 16 includes a glass 30 which, as illustrated, is double insulated glass. Alternatively, the glass 30 could be virtually any transparent or translucent material. Options currently available include tempered safety glass and other clear or bronze-tinted glasses. Each glass 30 is surrounded by, or enclosed within, a thermally broken frame 32 which includes a female side frame member 34 and a male side frame member 36.

The female side frame member 34 (FIG. 4) is a thermally broken extrusion including an outer portion 40, an inner portion 42, a thermal break 44, and a glass retainer 46. The outer portion 40 is generally planar and terminates at its glass end in a spacer leg or flange 48 which engages the glass 30. The outer portion 40 defines an integral thermal-break channel 50 and an integral glazing support 52. A glazing material (not shown), such as butyl caulk, is positioned on the glazing support 52 to engage the glass 30. The slight separation of the glazing support 52 and the flange 48 insures that glazing will not squeeze out into the viewing area of the glass 30 beyond the spacer flange.

The inner portion 42 (FIG. 4) is generally rectangular in cross section and includes an inner leg 60 extending from one corner of the rectangular shape. The inner portion 42 includes an integral thermal-break channel 62, integral screw channels 64 and 66, an integral screw channel 68, and a retainer channel 70. The screw channels 64 and 66 receive screws (not shown) at the corners of the frame 32 to interconnect the various frame members. The screw channel 68 opens through a visible portion of the inner extrusion 42 to provide an attachment means for accessories such as blinds and/or quilts. The retainer channel 70 receives the generally L-shaped retainer 46 to secure the glass 30 in position against the flange 48 and the glazing support 52. A panel-receiving channel 72 is defined between the inner leg 60 and the outer extrusion 40. The width of the female channel 72 is dimensioned to closely receive the male frame member 36 as will be described.

A thermal break 44 (FIG. 4) interconnects the outer and inner portions 40 and 42 in conventional fashion. The thermal break 44 completely fills the channels 50 and 62 to intersecure these pieces. Thus, the inner extrusion 42 is thermally insulated from the outer extrusion 40 by the thermal break 44.

The male side frame member 36 (FIG. 4) is dimensioned to fit within the female member 34. The male member 36 is a thermally broken extrusion including an outer portion 80, an inner portion 82, a thermal break 84, and a retainer 86. The outer portion 80 includes a glazing supporting portion 88, a thermal-break channel 90, and a bulb-seal channel 92. The portion 88 is serrated or grooved in the area facing the glass 30 to receive glazing compound to provide a weather seal against the glass. The bulb seal channel 92 faces the frame exterior and receives a conventional bulb seal to seal the male frame side member against the female side frame member in the assembled sun porch.

The inner portion 82 (FIG. 4) is generally rectangular in cross section and integrally defines a thermal-break channel 94, a bulb-seal channel 95, a pair of interior screw channels 96 and 98, an exterior screw channel 100, and a retainer channel 102. A bulb-seal is mounted in the channel 9 to seal the male side member 36 against the female side member 34. The screw channels 96 and 98 receive screws (not shown) to interconnect the various frame members to form the frame 32. The screw channel 100 opens through a visible interior portion of the frame to provide an attaching means for accessory hardware such as blinds and/or quilts. The retainer channel 102 receives a generally L-shaped retainer 86 to secure the glass 30 against the glazing portion 88.

A thermal break 84 (FIG. 4) interconnects the outer and inner portions 80 and 82. Specifically, the thermal break 84 fills both thermal-break channels 90 and 94 to interconnect and space the extrusions one from the other. Consequently, the inner extrusion 82 is thermally insulated from the outer extrusion 80 via the thermal break 84.

Figure 4:
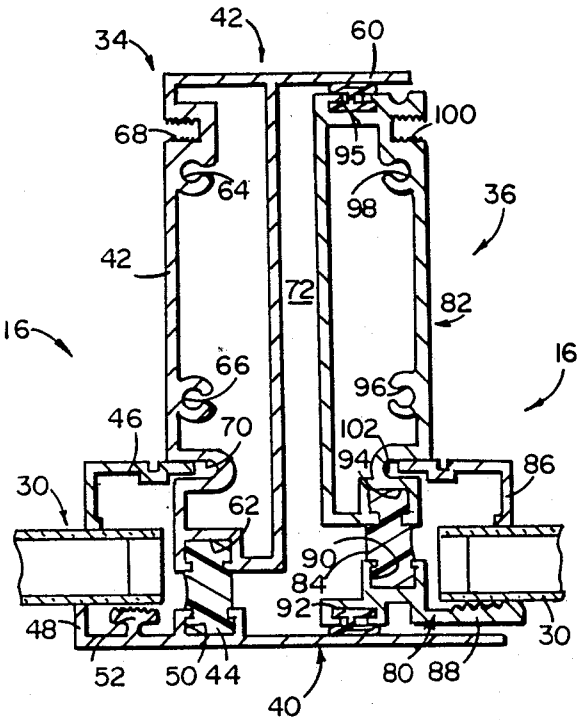
FIG. 4 is a fragmentary sectional view of two interfitted window panels taken along line IV—IV in FIG. 1.

As illustrated in FIG. 4, adjacent window panels 16 interfit in male/female relationship throughout the height of all engaging edges. Specifically, the male side frame member 36 is closely received within the female side member 34 of an adjacent window panel. The bulb seals carried within the bulb-seal channels 92 and 95 are compressed as the two panels are interfitted to provide a tight weather seal therebetween.

III. Corner Posts

The corner post 18 (FIG. 5) interconnects two nonlinearly aligned wall panels 16. In the preferred embodiment, the corner post 18 joins the two panels at a 90° angle. The corner post is a thermally broken extrusion including a body portion 180, an inner portion 182, a first connector portion 184, and a second connector portion 186.

The body portion 180 (FIG. 5) includes an L-shaped exterior wall 188 from which extend connector flanges 190 and 192 and a stop flange 193. The connector- rod socket 194 is supported by perpendicular support flanges 196 and 198 which are integrally connected to connector flanges 190 and 192, respectively. The connector flange 190 terminates in a thermal-break channel 200. The support flange 198 terminates in a perpendicular mounting flange 202. The exterior wall 188 includes a reduced portion 204 which terminates in an integral bulb-seal channel 206.

A connector rod 207 extends the full height of the corner post 18 and is anchored at its lower end in the base 14 and at its upper end to the front cap assembly 480 to be described.

The interior portion 182 (FIG. 5) is generally L-shaped including a first wall 208 and a second wall 210. An L-shaped flange 212 extends inwardly from the first wall 208; while the second wall 210 includes an inwardly facing bulb-seal channel 214 and an outwardly facing thermal-break channel 216.

The connector portion 186 (FIG. 5) at a first end is secured to the mounting flange 202 and at its opposite end defines an integral thermal-break channel 218. A thermal break 220 interconnects the inner portion 210 from the mounting portion 186. Specifically, the thermal break fills both channels 216 and 218 and spaces the two portions one from the other.

The connector portion 184 (FIG. 5) defines an integral thermal-break channel 222 and a flange 224 which interfits within the L-flange 212. A thermal break 226 interconnects the body portion 188 and the connector portion 184 to intersecure the pieces and provide thermal insulation therebetween. Specifically, the thermal break fills both channels 200 and 222 and spaces the portions one from the other.

Figure 5:
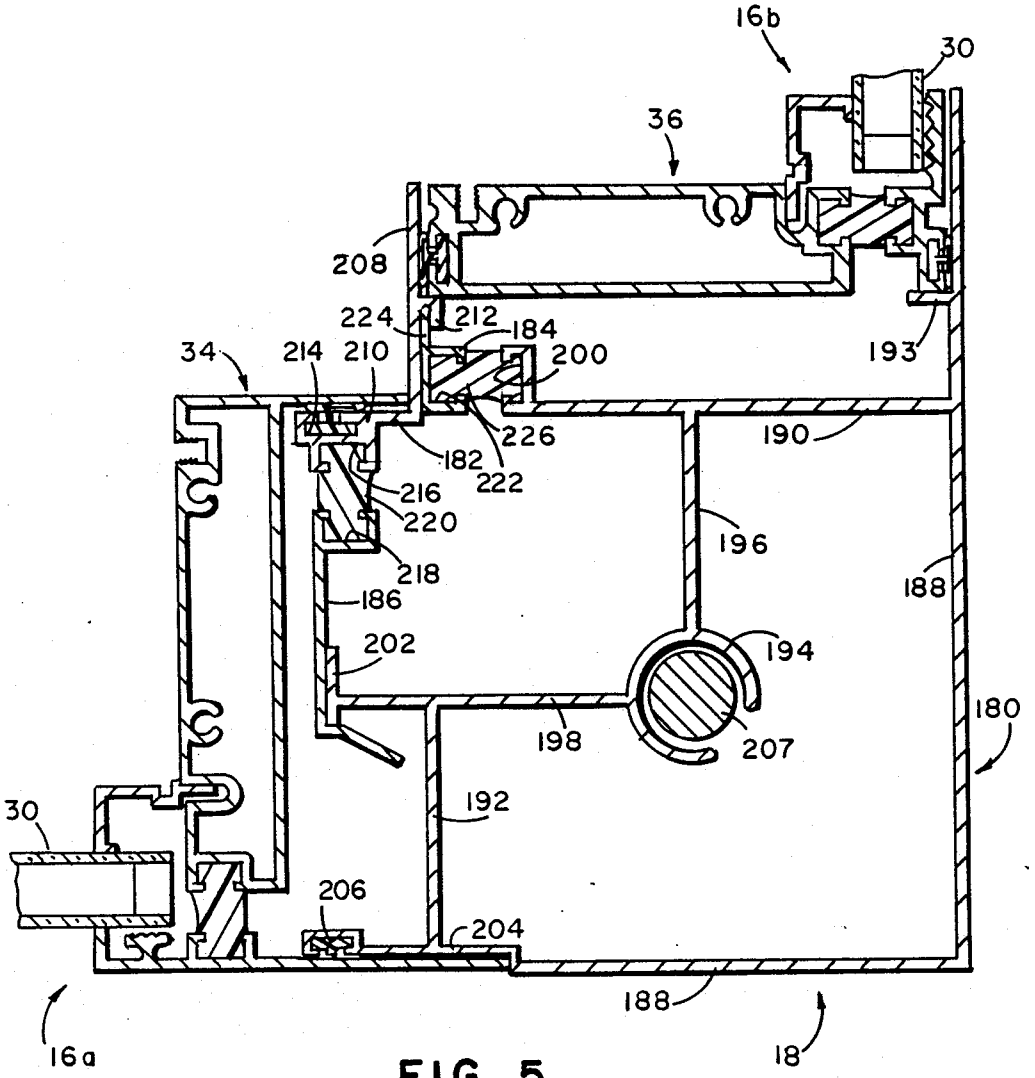
FIG. 5 is a fragmentary sectional view of the corner post assembly taken along line V—V in FIG. 1.

The L-flange 212 and the stop flange 193 lie within a common plane perpendicular to the outer wall 188 (FIG. 5). The outer wall 188, the inner wall 208, and the stops 212 and 193 thereby define a channel for receiving a male side member 36 as illustrated in FIG. 5. Similarly, the reduced portion 204 and the inner wall 210 define a male portion dimensioned to receive a female side member 34 thereover. Consequently, the corner post 18 receives the male side frame member of one panel and the female side frame member of a second panel to interconnect the two panels at an angle and to continue the male/female scheme through the corner of the sun porch 10.

IV. Wall Rails

Figure 7:
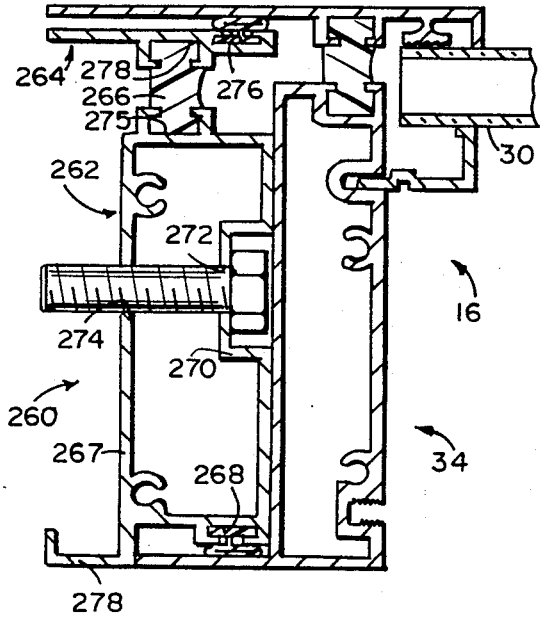
FIG. 7 is a fragmentary sectional view of the right wall rail assembly.
Figure 6:
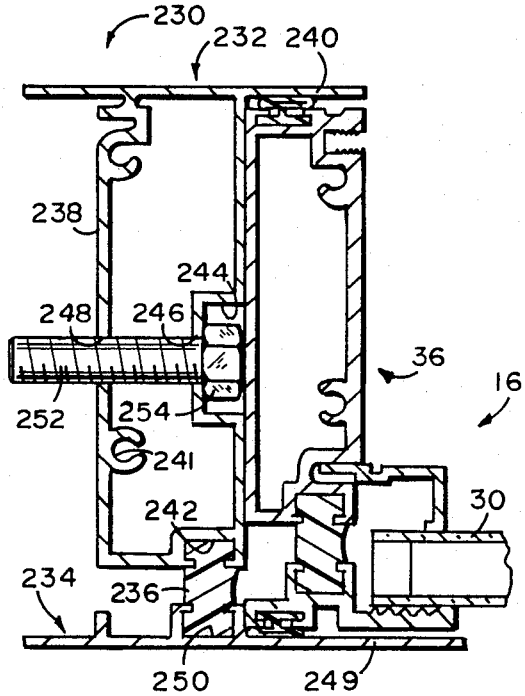
FIG. 6 is a fragmentary sectional view of the left wall rail assembly taken along line VI—VI in FIG. 1.

FIGS. 6 and 7 illustrate the attachment of the window panels to the existing building wall 12 (see FIG. 1 also). FIG. 6 illustrates the attachment of the left wall panel (when the sun porch 10 is viewed from the front), while FIG. 7 illustrates the attachment of the right wall panel.

The left wall rail 230 (FIG. 6) is a thermally broken extrusion including an interior portion 232, an exterior portion 234, and a thermal break 236 interposed therebetween. The interior portion 232 includes a generally rectangularly shaped body 238 and an elongated planar inner wall 240. The rectangular body 238 includes an integral screw channel 241, an integral thermal-break channel 242, and an integral bolt-head channel 244. Apertures 246 are provided within the floor of the bolt channel at spaced locations and apertures 248 are aligned therewith. The interior wall 240 extends beyond the width of the rectangular body 238 in both directions.

The exterior portion 234 (FIG. 6) is a generally planar member including an integral thermal-break channel 250. The inner wall 240 and the outer wall 249 are spaced one from the other to closely receive the male side frame member 36 of the panel assembly 16. The thermal break 236 intersecures the interior and exterior portions 232 and 234. Specifically, the thermal break fills both thermal- break channels 242 and 250 to space the two portions one from the other.

The left wall rail 230 (FIG. 6) is secured to the existing building structure 12 using a plurality, and preferably three, of lag bolts 252. The bolt heads 254 are recessed within the bolt-head channel 244 so that the male side frame member 36 of the window panel 16 ca abut the rectangular body 238 of the left wall rail.

Similarly, the right wall rail 260 (FIG. 7) provides a means for mounting a female side frame member 34 to the existing building structure. The right wall rail 260 is a thermally broken extrusion including an interior portion 262, an exterior portion 264, and a thermal break 266. The interior portion 262 is generally rectangular in cross section defining an integral screw channel 267, an integral bulb-seal channel 268, and an integral bolt-head channel 270. Apertures 272 are provided in the floor of the bolt-head channel 272 at spaced locations, and apertures 274 are aligned therewith permitting a plurality of, and preferably three, bolts to extend through the rectangular body. The interior portion 262 also defines an integral thermal-break channel 275 for receiving the thermal break material. A C-shaped flange 278 extends from one corner of the rectangular body 267 to provide a reference surface with the female side frame member 34.

The exterior portion 26 (FIG. 7) is generally planar and includes an outwardly opening integral bulb-seal channel 276 and an inwardly facing integral thermal-break channel 278. A thermal break 266 intersecures the interior and exterior portions 262 and 264. Specifically, the thermal break 266 fills both thermal break channels 27 and 278 to space the two portions one from the other. The outside distance between bulb seal channels 268 and 276 is dimensioned so that the female side frame member 34 can fit closely thereover. Conventional bulb seals are mounted within the channels 268 and 276 to be compressed by the female side frame member 34 to provide a weather-tight seal therebetween. Consequently, the female edge portion of one window assembly 16 can be connected to the existing building 12 without the necessity of a special panel. Such construction permits all modular panels to remain identical to one another.

V. Slidinq Door

Figure 8:
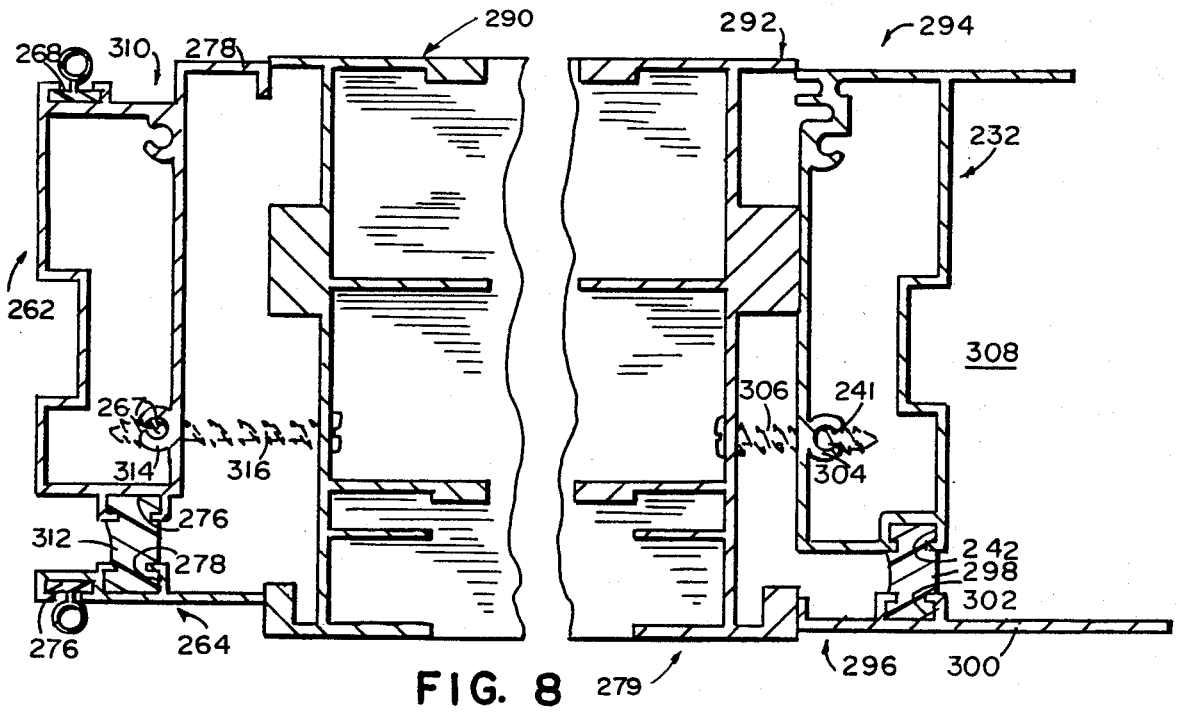
FIG. 8 is a fragmentary horizontal sectional view of the sliding door frame.

The sliding door assembly 279 (FIGS. 1, 2, and 8) is a conventional 58⅜"×79½" sliding door unit with a modified frame to interfit with the modular window panels 16. The slider 279 has a width twice that of one of the window panels 16; and the slider can therefore be substituted for any two window panels. FIG. 8 is a horizontal cross-sectional view through the sliding door frame, which includes a conventional left side member 290 and a conventional right side member 292 which are mirror images of each other. Such slider doors and frames are well known to those having ordinary skill in the art.

The female door post or adapter 294 (FIG. 8) is attached to the right frame member 292 to interfit with the male edge member 34 of a window panel assembly 16. The female frame adapter 292 is a thermally broken extrusion including an interior portion 232, an exterior portion 296, and a thermal break 298. The interior portion 232 is generally identical to the interior portion 232 illustrated in FIG. 6; and consequently a detailed description will not be again provided. Suffice it to say that the interior portion 232 includes an integral screw channel 241 and an integral thermal-break channel 242.

The exterior portion 296 includes a generally planar body 300 including an integral thermal-break channel 302 facing the channel 242. The thermal break 298 intersecures the inner and outer portions 232 and 296. Specifically, the thermal break 298 fills both channels 242 and 302 to space the portions one from the other. A plurality of, and preferably six, apertures 304 aligned with the screw channel 241 are drilled into the interior extrusion 232 to receive flat-head Phillips screws 306 to secure the left slider frame member 292 to the adaptor 294. The adaptor 294 defines a female channel 308 dimensioned to closely receive a male side frame member 36 of a window panel assembly 16. Alternately, the channel 308 could directly interconnect with a corner post 18 (FIG. 5) or the left wall rail 230 (FIG. 6).

Similarly, the male door post or frame adapter 310 (FIG. 8) permits the left slider frame member 290 to interfit with a female side frame member 32 of a window panel assembly 16. The adapter 310 is also a thermally broken extrusion including an interior portion 262 and an exterior portion 264 interconnected by a thermal break material 312. The interior and exterior portions 262 and 264 are generally identical to those illustrated in FIG. 7 and will therefore not be described in detail. Suffice it to say that the interior portion 262 includes an integral screw channel 267 and an integral thermal-break channel 276; and the exterior portion 264 includes an integral thermal-break channel 278. The thermal break material 312 interconnects the interior and exterior portions 262 and 264. Specifically, the thermal break material 312 fills both channels 276 and 278 to space the two portions one from the other. A plurality of, and preferably six, apertures 314 are formed in the interior portion 262 to be aligned with the screw channel 267. Flat-head Phillips screws 316 are secured within the screw channel to secure the right slider frame member 290 to the frame adapter 310. The male adapter 310 permits the left side of the slider to interfit with the female side frame member 32 of the adjacent window assembly 16. Alternately, the adapter 310 could interfit directly with a corner post 18 (FIG. 5) or the right wall rail 260 (FIG. 7).

VI. Swinq Door

Figure 9:
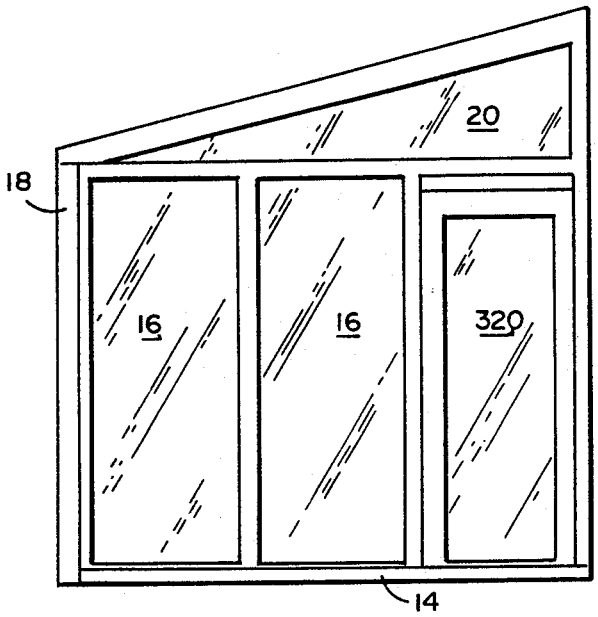
FIG. 9 is a right side elevational view of the sun porch showing an optional swing door.
Figure 12:
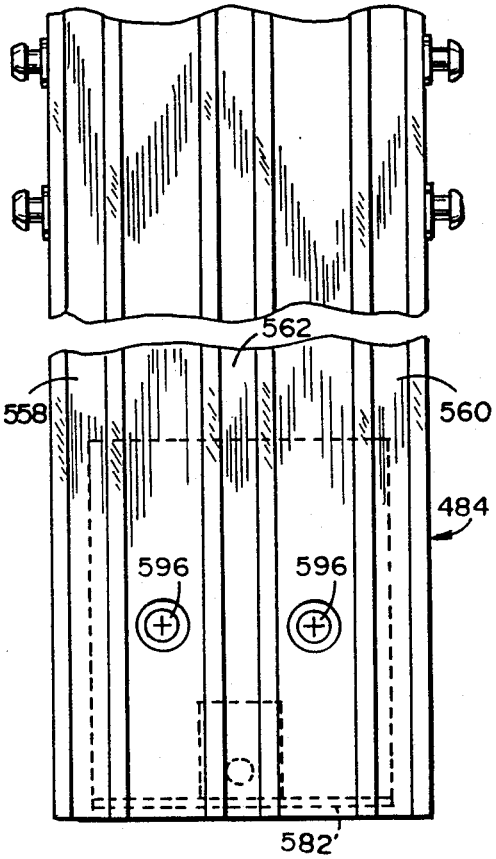
FIG. 12 is a fragmentary top plan view of a rafter with the gaskets removed.
Figure 10:
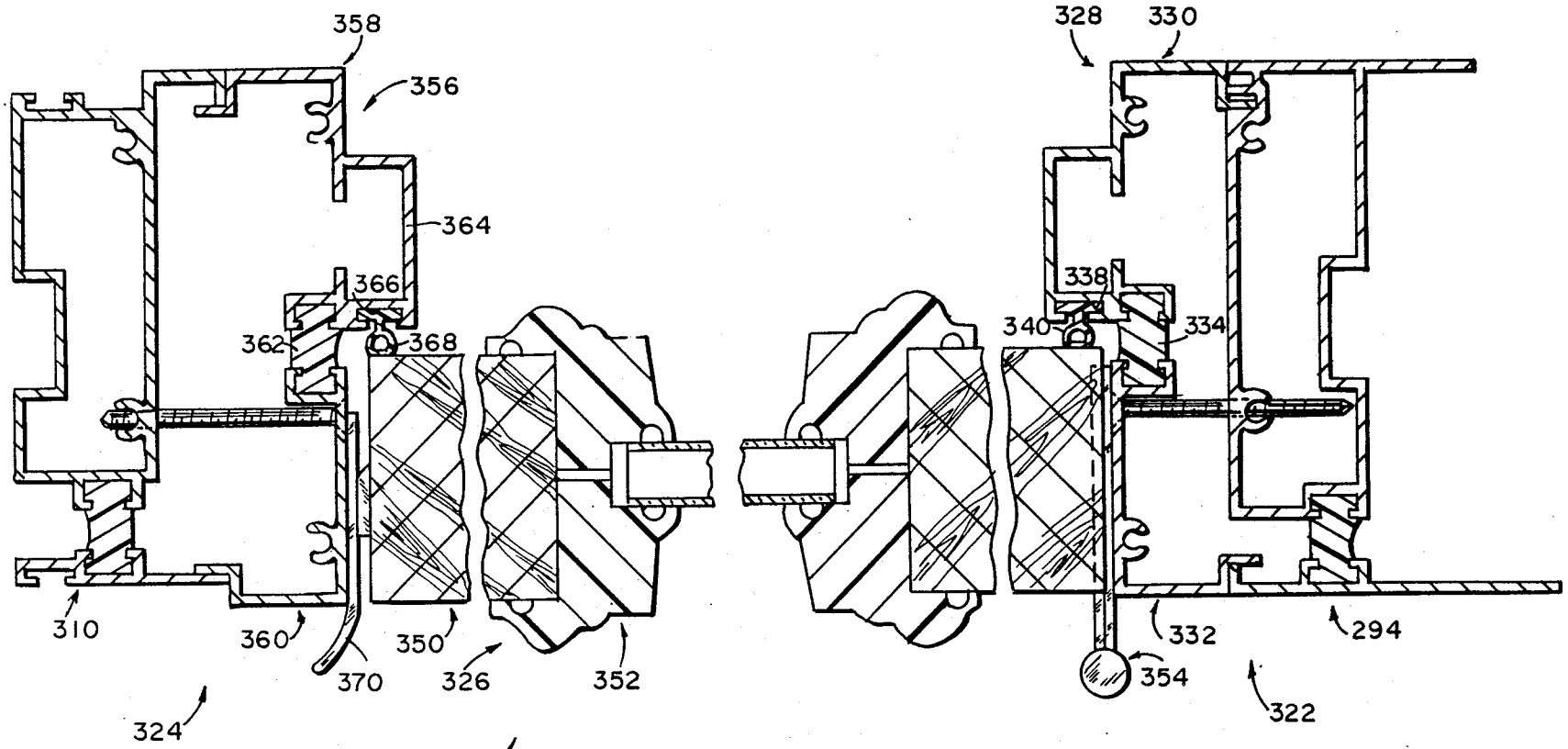
FIG. 10 is a fragmentary horizontal sectional view of the swing door.

FIG. 9 illustrates an alternate embodiment of the sun porch wherein a swing door unit 320 is substituted for one of the window panels 16. A horizontal cross section through the swing door unit 320 is illustrated in FIG. 10. The door unit includes a right frame assembly 322, a left frame assembly 324, and a swing door 326. The right frame assembly 322 includes a female door post or right frame adapter 294 and a right door jamb 328. The female frame adapter 294 is generally identical to that illustrated in FIG. 8; and consequently the detailed construction thereof will not be set forth again in detail. The right door jamb 328 is a thermally broken extrusion including an inner portion 330, an outer portion 332, and a thermal break 334, which interconnects the two portions and spaces them one from the other to provide thermal insulation therebetween. The right door jamb 328 integrally defines a bulb-seal channel 338 to support the bulb seal 340.

The left frame assembly 324 (FIG. 10) includes a male door post or left frame adapter 310 and a left door jamb 356. The left frame adapter 310 is generally identical to that illustrated in FIG. 8 and will not be redescribed in detail. The left door jamb 356 is also a thermally broken extrusion including an inner portion 358, an exterior portion 360, and an interconnecting thermal break 362. The inner portion 358 includes an integral left jamb 364 which in turn defines an integral bulb-seal channel 366. A bulb seal 368 is mounted within the channel 366 to provide a weather seal against the door 350. A strike plate 370 is mounted in conventional fashion on the left frame half 356 to receive the latch from the lock set (not shown) on the door 326.

The door 326 is of conventional construction including a door blank 350 and a door light 352 mounted therein. The door is swingably mounted to the right frame assembly 322 via hinges 354.

The width of the door unit 230 is generally identical to the width of one window panel 16. Consequently, the door unit 320 can be substituted for any panel 16 about the perimeter of the sun porch 10. Although the door is illustrated in FIG. 9 as being immediately adjacent the existing building 12, the location of the door 320 can be altered as desired. The left and right frame adapters 310 and 294 permit the door to interfit with the adjacent sun porch components to continue the modular construction about the perimeter of the sun porch. For example, the male adapter 310 can interfit with a female side frame member 34 (FIG. 4), the left wall rail 230 (FIG. 6), or the corner post 18 (FIG. 5). Similarly, the female adapter 294 can interfit with a male side frame member 36 (FIG. 4), the right wall rail 260 (FIG. 7), or the corner post 18 (FIG. 5).

VII. Triangles

The left triangle 20 (FIGS. 1 and 11) and the right triangle 20(FIG. 9) are mirror images of one another; and consequently only the left triangle will be described in detail. The left triangle 20 (FIG. 11) includes an upper rail assembly 380 and a lower rail assembly 382. The two rail assemblies are spaced from one another adjacent the existing building structure 12 and meet one another at the front face of the sun porch 10.

The upper rail assembly 380 (FIG. 11) is a thermally broken extrusion including a body portion 384, a top portion 386, an exterior portion 388, and a bottom portion 390. The body portion 384 is generally rectangular in cross section and defines an integral thermal-break channel 392 at its upper outer corner and an integral gasket channel 394 at its upper inner corner. The lower outer corner 396 is recessed and includes a snap flange 398.

The top portion 386 (FIG. 11) is generally C-shaped in cross section and defines an integral thermal-break channel 400 therein. The body portion 384 and the top portion 386 are interconnected by the thermal break 382. Specifically, the thermal break fills both channels 392 and 400 to space the two portions one from the other.

The exterior portion 388 (FIG. 11) is generally L-shaped in cross section including an exterior wall 404 and an upper exterior wall 406. A spacing flange 410 extends along the interior surface of the top wall 406 to engage the top portion 386. The top wall 406 terminates in a top flange 412 having a downwardly extending finger flange 414. The flanges 412 and 414 extend about the top portion 386 to secure the exterior portion 388 in position at its upper end. A spacer flange 420 extends inwardly along the lower edge of the exterior wall 404. Just above the spacing flange 420 is a glazing support 422; and just above the glazing support is a thermal-break support 424 including a thermal-break channel 426.

The bottom portion 390 (FIG. 11) includes an integral thermal-break channel 428, a flange channel 430, and a snap channel 432. A ramped surface 434 leads to the snap channel 432 to facilitate the insertion of the snap flange 398 therein. A thermal break 434 interconnects the exterior portion 388 and the bottom portion 390. Specifically, the thermal break 434 fills both channels 426 and 428 to space the two portions one from the other. A generally L-shaped retainer 436 is fitted within the channel 430 and bears against the window glass 438 to secure the glass in position. Preferably, a glazing compound (not shown) is mounted on the glazing support 422 to provide a weather seal against the glass 438. The spacing flange 420 prevents the glass 438 from engaging the glazing support 422 and also prevents squeeze-out into the viewing area.

The glass 438 is typically generally identical to the glass 30; however, any suitable panel can be used. The glass 430 is generally triangular in shape having the upper rail assembly 380 extending along its upper edge and the lower rail assembly 382 extending along its lower edge.

The bottom rail assembly 382 of the triangle 20 (FIG. 11) is adapted to support the triangle on the wall panels 16 and/or the doors possibly substituted therefor. The bottom rail assembly is a thermally broken extrusion including an interior portion 450, an exterior portion 452, and a thermal break 454 extending therebetween. The interior portion 450 is generally rectangular in cross section and includes an integral retainer channel 456 and an integral thermal-break channel 458. A bulb-seal support 460 extends downwardly and includes an integral bulb-seal channel 462.

The exterior portion 452 (FIG. 11) includes a spacing flange 464 along its upper edge and a glazing support 466 just therebelow. The exterior bulb-seal support 468 extends downwardly and includes an integral bulb-seal channel 470. The thermal-break channel 471 faces the channel 458. The thermal break 454 interconnects the interior and exterior portions 450 and 452. Specifically, the thermal break fills both channels 458 and 471 to space the portions one from the other. An L-shaped retainer 472 fits within the retainer channel 456 and bears against the glass 438. A glazing compound (not shown) is carried by the glazing support 466 to provide a weather seal against the window glass 438. The bulb channels 462 and 470 closely receive therebetween the window panels 16 in male/female fashion.

VIII. Roof Assemblv

Figure 13:
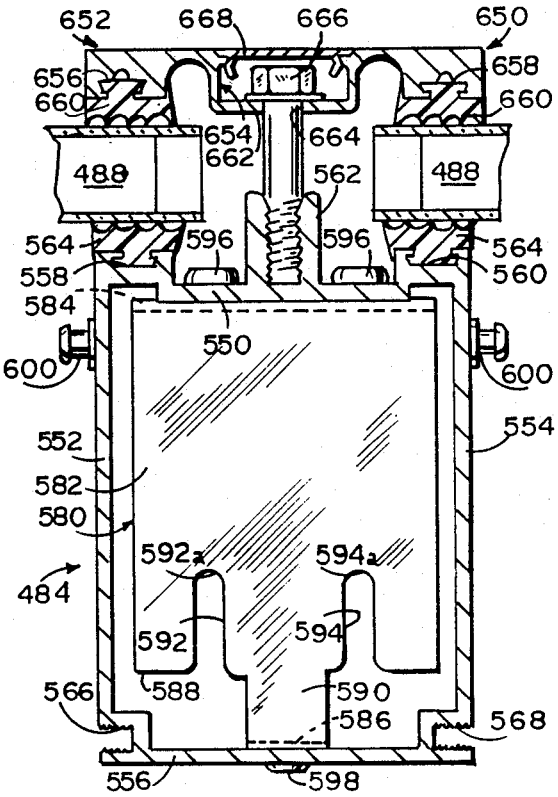
FIG. 13 is a sectional view of a rafter taken along line XIII—XIII in FIG. 2.

FIGS. 12–15 illustrate the construction of the roof assembly 22 (see also FIG. 1). The roof assembly includes a top cap assembly 480, a building beam assembly 482, a plurality of rafters 484 (FIGS. 12 and 13) a plurality of purlins 486 (FIGS. 14 and 15), a plurality of roof panels 488, and a plurality of retainers 490 (FIGS. 11 and 13).

The front cap assembly 480 (FIG. 15) is a thermally broken extrusion including a plurality of extruded portions. The top cap assembly 480 defines a bottom channel 492 including a pair of inwardly facing bulb-seal channels 494 and 496. The channel 492 fits over the top portion of the wall channels 16 in male/female fashion. Additionally, the top cap assembly 480 includes an exterior portion 498 and an interior portion 500. A plurality of shoulder screws 502 are secured within the interior portion 500 to support the rafters as will be described. A resiliently compressible gasket 504 is mounted on the upper portion of the interior portion 500 within the channel 505 to support a roof panel 488 also as will be described Thermal breaks 506 and 508 are provided within the top cap assembly to thermally insulate the interior portion of the top cap from the exterior portion.

Figure 15:
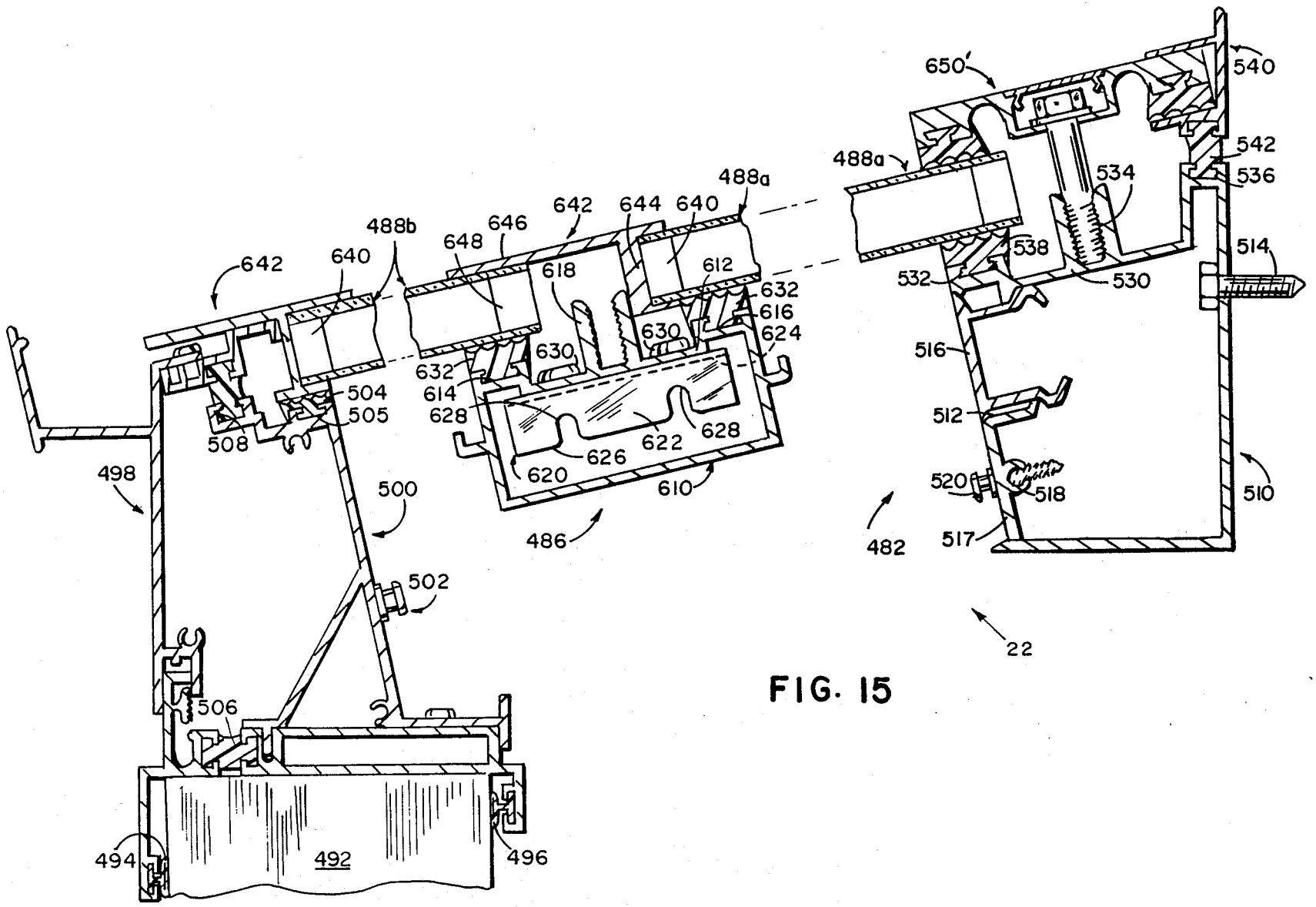
FIG. 15 is a fragmentary sectional view of the roof assembly taken along line XV—XV in FIG. 2.

The wall plate or building beam 482 (FIG. 15 supports the roof assembly 22 on the existing building structure. The building beam 482 includes a body extrusion 510 which is generally quadrilateral in cross section and defines an opening 512 along its length. Lag bolts 514 or other suitable fasteners are utilized to secure the building beam assembly 482 to the existing building structure. The access opening 512 provides access to the lag bolts 514. An elongated cap 516 is snap-fitted within the opening 512 to cover the access opening subsequent to securement of all lag bolts 514. The body portion 510 includes an interior wall 517 which includes an integral screw channel 518 on the underside thereof. A plurality of shoulder screws 520 are secured at spaced locations within the screw channel 518 along the length of the building rail 510 to support the rafters 484 as will be described. The body portion 510 also includes a top wall 530 which defines an upwardly opening gasket channel 532, a screw channel 534, and a thermal-break channel 536. A resiliently compressible gasket 538 is mounted within the gasket channel 532 to directly engage and support the roof panel 488. The screw channel 534 receives bolts to secure the retainer 650′ in position as will be described. Flashing portion 540 is secured to the body extrusion 510 via the thermal break 542.

The rafter 484 (FIGS. 12 and 13) includes an extrusion generally rectangular in cross section. The extrusion includes a top wall 550, a pair of opposite side walls 552 and 554, and a bottom wall 556. The top wall 550 defines a pair of upwardly opening gasket channels 558 and 560 along the outboard edges adjacent the side walls 552 and 554, respectively. A screw channel 562 extends upwardly from the center of the top wall 550 to receive bolts anchoring the retainers 650 in position as will be described. Resiliently compressible gaskets 564 are fitted within the channels 558 and 560 to directly engage and support the roof panels 488 and provide a weather seal thereagainst. Screw channels 566 and 568 open outwardly through the side walls 552 and 554, respectively, adjacent the bottom wall 556 to provide a means of securing accessories such as blinds or quilts to the rafters. A plurality of shoulder screws 600 are secured within the side walls 552 and 554 of the rafter 484 to support the purlins as will be described.

The rafters 484 each have a length sufficient to extend the full distance between the top cap assembly 480 and the building beam 482 (see also FIG. 15). The rafters 484 are supported on the shoulder screws 502 and 520; and to this end rafter brackets 580 (FIGS. 12 and 13) are mounted in either end of each rafter. Specifically, the rafter bracket includes a face 582, a top flange 584, and a bottom flange 586. The face 582 is oriented in a plane generally perpendicular to the axial direction of the rafter 484. The face is generally rectangular including a lower edge 588 and a tab 590 extending downwardly from the central portion of the face 582. A pair of slots 592 and 594 extend upwardly into the face 582 from the lower edge 588 and terminate in semi-spherical ends 592*a* and 594*a*, respectively. The top flange 584 is integral with and generally perpendicular to the face 582. The top flange is secured to the underside of the top wall 550 of the rafter 484 using pan-head Philip screws 596 preferably at four locations. The lower flange 586 is integral with and generally perpendicular to the tab 590 and is secured to the bottom wall 566 of the rafter 484 using rivets 598 preferably at two locations. As best seen in FIG. 13, the rafter bracket 580 is confined within the cross-sectional shape of the rafter 484.

The rafter 484 is mounted between the top cap assembly 480 and the building beam 482 by interfitting the rafter brackets 580 on the shoulder screws 502. Preferably, the slots 592 in the rafter bracket 580 are aligned with the shoulder screws 502 on the top cap assembly 480 and the bracket is slid downwardly into position.

The slots 592 in the opposite end of the beam are then aligned with the shoulder screws 520 in the building beam assembly 482 and that end of the beam is also then lowered into position. The shoulder screws 502 and 520 are also within the lateral confines of the cross-sectional shape of the rafters 484, or the imaginary extension of that cross-sectional shape. Further, each rafter end abuts or is closely adjacent the top cap assembly 480 or the building beam assembly 482 to completely hide the attachment assembly. Consequently, the resultant attachment assembly is completely hidden from view.

The roof purlins 486 (FIGS. 14 and 15) extend between adjacent rafters 484 to support two adjacent roof panels 488. Each purlin includes a body extrusion 610 which is generally rectangular in cross section including a top wall 612 which defines upwardly opening gasket channels 614 and 616. A resiliently compressible gasket 632 is mounted within each of the gasket channels 614 and 616 to directly engage and support the roof panels 488 and provide a weather seal thereagainst. An integral screw channel 618 extends upwardly from the center of the top wall 612 to prevent the upper roof panel assembly **488*a* from sliding downwardly and perhaps over the lower roof panel assembly 488*b*** during installation.

One purlin bracket 620 (FIGS. 14 and 15) is secured within each end of the purlin and includes a face 622 and a top flange 624. The face 622 is generally perpendicular to the longitudinal direction of the purlin body 610 and includes a lower edge 626. A pair of slots 628 extend upwardly into the face 622 from the lower edge 626 to receive the shoulder screws 600 (see also FIGS. 12 and 13). The top flange 624 is secured to the underside of the top wall 612 of the rafter extrusion 610 using pan-head Phillip screws 630.

The purlins 486 are readily and easily installed between adjacent rafters 484. Specifically, the slots 628 within the purlin brackets 620 are aligned with the shoulder screws 600 in adjacent rafters, and the purlin is lowered into position so that the bracket 620 travels downwardly about the shoulder screws to retain the purlin in position. As perhaps best illustrated in FIG. 15, the attaching structure including the bracket 620 and the shoulder screws 600 lie entirely within the lateral confines of the cross-sectional shape of the purlin 486 or its imaginary extension thereof. Further, the purlin extrusion 610 is closely adjacent the opposite rafters between which it is mounted to hide the connection assembly from view after the purlin is slid into position.

The roof panels 488 (FIGS. 11 and 15) are all preferably identical to the window glass 30 in the window panel 16 and the window glass 438 in the triangles 20. Of course, alternate transparent or translucent panels can also be used. The roof panels 488 rest directly on one gasket on each of two adjacent rafters 484 or on a triangle and the adjacent rafter. Each panel 488 also rests on one gasket of a purlin 486 and the gasket of either top cap assembly 480 or building beam 482. Because each of the resiliently compressible gaskets is continuous throughout the full length of the member on which it is mounted, an effective weather seal is provided around the entire periphery of each roof panel 488.

The lower edge 640 (FIG. 15) of the roof panels 488 is fitted within a spacer 642. The spacer includes a C-shaped portion 644 fitted about the lower edge 640 and a flange portion 646 extending therefrom and over the upper edge 648 of the lower panel **488*b*. The spacer 642 prevents the glass roof panel 488 from directly engaging the top cap assembly 480 or the screw boss 618** and also provides integral flashing.

One retainer assembly 650 is mounted on each rafter after the adjacent window panels supported thereon are in position. The retainer assembly 650 includes a retainer extrusion 652 defining a bolt-head channel 654 extending downwardly from the inner surface and also a pair of downwardly opening gasket channels 656 and 658. Resiliently compressible gaskets 660 are fitted within the gasket channel 656 and 658 to engage the roof panels 488 and provide a weather seal thereagainst. The bolt-head channel 654 includes a floor 662 having apertures 664 at spaced locations therealong. Hex head bolts 666 extend through the channel floor 662 and into the screw boss 562 to secure the retainers in position. A retainer cap 668 is snap-fitted within the bolt-head channel 654 after all bolts 66 have been installed to cover the bolt heads and provide an aesthetically pleasing appearance. A retainer assembly 650' (FIG. 15) of identical construction is used to secure the upper roof panels **488*a* against the building beam assembly 482**.

IX. Installation Summarv

The sun porch 10 is easily and readily assembled onto an existing building 12. Preparation begins by pouring a concrete pad 11 of suitable depth, preferably four inches, and having a suitable footing thereabout. Preferably, prior to the setting of the concrete, the anchor bolts 116 (FIG. 3) are set within the concrete.

After the concrete has set, the base assembly 14 is secured to and leveled on the pad 11 as described in conjunction with the description of FIGS. 3A and 3B. The wall rails 230 and 260 and the top beam 482 are then secured to the existing building 12; and the first window panel 16 is interfitted therewith. Specifically, the female side frame member 34 of the window assembly 16 is interfitted over the male portion of the right wall rail. The second window panel assembly is then interconnected with the first window assembly in similar male/female relationship. Installation of the window panels continues until the corner is reached. At that point, a corner post 18 (FIG. 5) is placed into position and interfitted in male/female relationship with the adjacent wall panel 16.

Assembly of the remainder of the wall continues in sequential fashion until all of the modular components are in position. Finally the left building rail (FIG. 6) is secured to the existing building 12 so that the last wall panel 16 can be placed into position.

After all walls have been erected, the triangles 20 and the top cap assembly 480 (FIG. 15) are mounted over the wall panels 16 and any slider or door mounted therein. The tie rods 207 are anchored within the base assembly 14, extend through the corner post 18, and are secured against the top cap assembly 480. The undersides of the triangles and top cap fit in male/female relationship with the upper edge of the wall panels.

The rafters 484 (FIGS. 12 and 13) are then mounted between the top cap assembly 480 and the building beam 482 by sliding the rafters downwardly into position over the shoulder screws 502 and 520. The purlins 486 (FIGS. 14 and 15) are then installed between the rafters by sliding their brackets over the shoulder screws 600 secured in the rafters.

The roof panels 488 are then placed in position. Preferably, each lower panel is placed in position prior to the associated upper panel. Finally, the retainer assemblies 650 and 650' (FIGS. 13 and 15) are installed to secure the roof panels against the rafters 484 and the building beam assembly 482.

The modular door assemblies 279 and 320 can be substituted for one or more of the window panel assemblies at any position about the perimeter of the sun porch. Specifically, the slider unit 279 can be substituted for any two adjacent window panel assemblies 16; and the swinging door unit 320 can be substituted for any single window panel assembly 16. Because of the unique male/female configuration of the slider and swinging door frames, these units can easily interfit with the existing male/female scheme.

Thus, it is seen that the sun porch can be readily and easily assembled by home owners or other "do-it-yourselfers" having relatively limited carpentry or construction skills. Further, the sun porch can be assembled extremely easily by one having the described skills to reduce assembly time and thus the ultimate cost of the assembled sun porch 10.

The above description is that of a preferred aspect of the invention. Various alterations and changes can be made without departing from the spirit and broader aspects of the invention which are defined in the appended claims, which are to be interpreted in accordance with the principles of patent law, including the doctrine of equivalents.

The embodiments of the invention in which an exclusive property or privilege is claimed are defined as follows:

1. A sun porch especially adapted to be added to an existing building structure, said sun porch comprising:

a plurality of generally identical interfitting window panels each including a frame having a male side member and a female side member, all of said male side members being generally identical to one another and all of said female side members being generally identical to one another, each female side member being adapted to receive one of said male side members such that each said female side member confines said received male side member against movement relative thereto in only three directions;

a corner post means for receiving two nonparallel window panels, said corner post means extending substantially the full height of said window panels, said corner post means including a female portion for receiving one of said male side members such that said male side member is confined therein against movement relative thereto in only three directions and a male portion for receiving thereover one of said female side members such that said male portion is confined therein against movement relative in only three directions, said corner post means thereby enabling two of said window panels to meet in a corner; and base means for supporting said window panels above a support surface, said base means defining one of a male structure or female structure and said window panel frames each having lower edges defining the other of said male or female structures, said female structures being adapted to receive said male structures such that said female structures confine said received male structures against movement relative thereto in only three directions.

2. A sun porch as defined in claim 1 further comprising:

a male wall rail having fastening means for fixedly attaching said male wall rail to a building structure, and having a male section configured to interfit with any one of said female side members such that said female side member receives said male section and is thereby confined against movement relative thereto in only three directions; and a female wall rail having fastening means for fixedly attaching said female wall rail to a building structure, and having a female section configured to receive any one said male side members such that said female wall rail receives said male side member and confines said male side members against movement relative thereto in only three directions; whereby said building rails enable said window panels to be securely joined to the building structure.

3. A sun porch as defined in claim 1 further comprising door means for providing ingress to and egress from said sun porch, said door means including a frame having a door male side member to be interfitted with one of said window panel female side members such that said door male side member is received within said window panel female side member and confined therein against movement in only three directions relative thereto and a door female side member to be interfitted with one of said window panel male side members such that said window panel male side member is received within said door female side member and is confined therein against movement in only three directions relative thereto, whereby said door means can be substituted for one or more of said window panels.

4. A sun porch as defined in claim 1 further comprising sealing means carried by said window panels and compressed by said interfitting male and female side members to provide a weather seal therebetween.

5. A sun porch as defined in claim 1 further comprising roof means for covering said sun porch, said roof means having one of a male and female members and said window panel frames each having upper edges defining the other of said male and female members, wherein said female member is adapted to receive said male member such that said female member confines said received male member against movement relative thereto in only three directions.

6. A sun porch as defined in claim 5 further comprising:

a male wall rail having fastening means for fixedly attaching said male wall rail to a building structure, and having a male section configured to interfit with any one of said female side members such that said female side member receives said male element and is thereby confined against movement relative thereto in only three directions; and a female wall rail having fastening means for fixedly attaching said female wall rail to a building structure, and having a female section confined to receive any one said male side members such that said female wall rail receives said male side member and confines said male side members against movement relative thereto in only three directions; whereby said building rails enable said window panels to be securely joined to the building structure.

7. A kit for assembly a sun porch to be attached to an existing building structure comprising:

a plurality of transparent panel assemblies each including a transparent panel and a frame extending about the periphery of said panel, said frame including a male side member and a female side member, each said female side member defining a U-shaped recess having a substantially uniform transverse shape such that the female side member of any panel assembly is configured to matingly interfit with the male side member of any other panel assembly, whereby said transparent panel assemblies can be interfitted together to define a wall;

base means for supporting said panel assemblies above support surface, said base means including an upwardly opening channel defining a substantially uniform U-shaped recess for matingly receiving said panel assembly frames;

a corner post assembly for interconnecting two non-linearly aligned panel assemblies, said corner post assembly including a female portion defining a U-shaped recess with a substantially uniform transverse shape, said female portion being configured to matingly receive any one of said male side members and a male portion configured to matingly interfit with any one of said female side members; and roof means for covering said sun porch, said roof means defining one of a male structure and female structure and said panel assembly frames each having an upper edge defining the other of said male and female structures, wherein each said female structure defines a generally U-shaped uniform recess adapted to matingly interfit with said male structure.

8. A sun porch as defined in claim 7 further comprising:

a male wall rail having fastening means for fixedly attaching said male wall rail to a building structure, and having a male section configured to matingly interfit with any one of said female side members; and a female wall rail having fastening means for fixedly attaching said female wall rail to a building structure, and having a female section configured to define a U-shaped recess having a generally uniform transverse shape, said wall rail recess being adapted to matingly receive any one of said male side members, whereby said building rails enable said window panels to be securely joined to the building structure.

9. A kit for assembling a sun porch to be attached to an existing building structure comprising:

a plurality of transparent panel assemblies each including a transparent panel and a frame extending about the periphery of said panel, said frame including a male side member and a female side member, each said female side member defining a U-shaped recess having a substantially uniform transverse shape such that the male side member of any panel assembly is configured to matingly interfit with the male side member of any other panel assembly, whereby said transparent panel assemblies can be interfitted together to define a wall;

base means for supporting said panel assemblies above a support surface, said base means including an inwardly opening channel defining a substantially uniform U-shaped recess for matingly receiving said panel assembly frames;

a corner post assembly for interconnecting two non-linearly aligned panel assemblies, said corner post assembly including a female portion defining a U-shaped recess with a substantially uniform transverse shape, said female portion being configured to matingly receive any one of said male side members and a male portion configured to matingly interfit with any of said female side members;

a male wall rail having fastening means for fixedly attaching said male wall rail to a building structure, and being configured to matingly interfit with any one of said female side members; and a female wall rail having fastening means for fixedly attaching said female wall rail to a building structure, and being configured to define a U-shaped recess having a generally uniform transverse shape, said wall rail recess being adapted to matingly receive any one of said male side members, whereby said building rails enables said window panels to be securely joined to the building structure.

10. A kit for assembling a sun porch to be attached to an existing building structure comprising:

a plurality of transparent panel assemblies each including a transparent panel and a frame extending about the periphery of said panel, said frame including a male side member and a female side member, each said female side member defining a U-shaped recess having a substantially uniform transverse shape such that the female side member of any panel assembly is configured to matingly interfit with the male side member of any other panel assembly, whereby said transparent panel assemblies can be interfitted together to define a wall;

base means for supporting said panel assemblies above a support surface, said base means including an upwardly opening channel defining a substantially uniform U-shaped recess for matingly receiving said panel assembly frames;

a corner post assembly for interconnecting two non-linearly aligned panel assemblies, said corner post assembly including a female portion defining a U-shaped recess with a substantially uniform transverse shape, said female portion being configured to matingly receive any one of said male side members and a male portion configured to matingly interfit with any one of said female side members; and door means for providing ingress to and egress from said sun porch, said door means including a frame having a door male side member to be matingly interfitted with one of said window panel female side members and a door female side member defining a U-shaped recess having a generally uniform transverse shape, said door side member recess being adapted to be matingly interfitted with one of said window panel male side members, whereby said door means can be substituted for one or more of said window panels.

11. A modular sun porch comprising:

a plurality of generally identical interfitting window panel assemblies adapted to be matingly interconnected to form a wall, each of said window panel assemblies including a frame, which in turn, includes a male side frame assembly and a female side frame assembly, each extending the full height of said window panel assembly, each said female side frame assembly defining a recess adapted to matingly receive one of said male side frame assemblies therein at a certain depth, each said recess having a generally uniform width through said certain depth, each said frame further including an upper edge defining one of a male structure and female structure;

corner means for interconnecting said window panel assembly to form a corner, said corner means including male means for matingly interfitting with one of said female side frame assemblies and female means defining a recess for matingly receiving one of said male side frame assemblies at a certain depth, said corner means recess having a generally uniform width through said certain depth; and roof means for covering said sun porch, said roof means including the other of said male and female structures opposite said upper edge of said window frames, each said female structure defining a cavity adapted to matingly receive at least one of said male structures at a certain depth, said cavities having a generally uniform width through said certain depth.

12. A modular sun porch as defined in claim 11 further comprising base means for supporting said window panel assemblies above a support surface, each said frame having a lower edge defining one of a male structure and female structure and said base means defining the other of said male and female structures, each said female structure defining a recess adapted to matingly receive one of said male structures at a certain depth, said base means recess having a generally uniform width through said certain depth.

13. A modular sun porch as defined in claim 11 further comprising door means for providing a door into said sun porch, said door means including a frame having a male section and a female section, said male section being adapted to be matingly received within one of said female side frame assemblies and said female section defining a recess adapted to matingly receive one of said male side frame assemblies at a certain depth, said female section recess having a generally uniform width through said certain depth.

14. A modular sun porch kit comprising:

a plurality of generally uniform width panels each including a frame having a male side member and a female side member extending the full height thereof, said side members being configured so that the male side member of each panel includes a pair of generally parallel lateral walls which define the largest transverse dimension to mention of said male side member and so that the female side member of each panel includes a pair of generally parallel lateral walls which define a channel therebetween adapted to matingly receive therein said lateral walls of said male side member of an adjacent linearly aligned panel;

a door unit including a frame having a male side member and a female side member extending the full height thereof, said door frame side members being configured so that the door male side member will matingly fit into said channel of one of the panel frame female side members and so that the door female side member will matingly receive one of the panel frame male members, the width of said door unit being a multiple of the width of the panels, whereby said door unit can be substituted for one or more of said panels at any location about the periphery of the assembled sun porch;

a corner post assembly for interconnecting two nonlinearly aligned window panel assemblies, said corner post including a male portion configured to extend and be matingly received into the channel of said female side member of one panel assembly and a female portion configured to matingly receive the male side member of a second panel assembly; and sealing means for weather sealing the mating interconnection of said window panels between said adjacent lateral walls of said male and female side members, and for weather sealing said mating interconnection between said window panels and said corner post assembly.

15. A modular sun porch kit as defined in claim 14 wherein said panels are generally identical to one another.

16. A modular sun porch as defined in claim 14 further comprising:

a male wall rail having fastening means for fixedly attaching said male wall rail to a building, and having a male section configured to matingly receive a female panel frame side member thereover, and a female wall rail having fastening means for fixedly attaching said female wall rail to a building, and having a female section configured to matingly receive a male panel frame side member therein, whereby said panel assemblies can be secured to a building.

17. A modular sun porch as defined in claim 14 further comprising base means for supporting said panels above a supporting surface, each said frame of said panels further including a lower edge defining a male structure, each said male structure having a pair of generally parallel walls defining the largest transverse dimension of said frame, said base means including a pair of upstanding flanges defining a gap matingly receiving said lower male structures of said panels, and base sealing means for weather sealing said mating interconnection of said base means and said panels between said base flanges and said male structures.

18. A modular sun porch as defined in claim 17 further comprising roof means for enclosing the sun porch, each said frame of said panels further including an upper edge defining a male portion, each said male portion having a pair of generally parallel walls defining the largest transverse dimension of said frame, said roof means including a pair of downwardly extending flanges defining a gap matingly receiving said upper male portions of said panels, and roof sealing means for weather sealing said mating interconnection of said roof means and said panels between said roof flanges and said male portions.

19. A modular sun porch as defined in claim 14 further comprising roof means for enclosing the sun porch, each said frame of said panels further including an upper edge defining a male portion, each said male portion having a pair of generally parallel walls defining the largest transverse dimension of said frame, said roof means including a pair of downwardly extending flanges defining a gap matingly receiving said upper male portions of said panels, and roof sealing means for weather sealing said mating interconnection of said roof means and said panels between said roof flanges and said male portions.

20. An improved sun porch including a wall assembly and a roof assembly wherein the improvement comprises said roof assembly comprising:

a pair of spaced parallel beam members each including a plurality of support members extending therefrom toward the other beam member, said support members including shoulder screws; and a plurality of rafters each extending between said beam members and each including a pair of opposite ends adjacent said beam members and each having a cross-sectional shape, each end including support means for supporting said rafter end on at least one of said support members, each said support means being within the confines of the associated cross-sectional shape or extension thereof, each said support means including a slotted bracket secured to the associated rafter end, said bracket including at least one downwardly opening slot adapted to fit over the associated shoulder screw such that said support means slidingly receives said support member as said rafter is lowered into position, whereby each said rafter is secured in position on each said beam by simply lowering said rafter onto said support members, and further whereby said support means and said support member are substantially hidden.

21. A kit for constructing a sun porch roof comprising:

first and second beams adapted to be positioned parallel one another;

a plurality of rafters each including first and second ends to be supported by said first and second beams, respectively;

support means on at least one of said beams and said rafters for supporting said beams on said rafters, the entire cross-sectional periphery of each of said rafter ends being adjacent said respective beam, each said support means being within the lateral confine of the cross-sectional configuration of the associated rafter or an imaginary extension thereof, each said support means including a plurality of shoulder screws secured within said first and second beams, each said rafter end defining at least one downwardly opening slot slidingly fit over one of said shoulder screws, whereby said support means is essentially hidden from view in the assembled sun porch roof; and a plurality of roof panel assemblies adapted to be supported on selected ones of said beams and said rafters.

22. A kit as defined in claim 21 wherein each said rafter end includes a bracket defining said slot.

* * * * *

UNITED STATES PATENT AND TRADEMARK OFFICE

CERTIFICATE OF CORRECTION

PATENT NO. : 4,884,376

DATED : December 5, 1989

INVENTOR(S) : David A. DeBlock and Kert E. Artwick

It is certified that error appears in the above-identified patent and that said Letters Patent is hereby corrected as shown below:

Column 15, line 55:

Insert "thereto" after --relative--.

Signed and Sealed this

Sixteenth Day of October, 1990

*Attest:*

HARRY F. MANBECK, JR.

*Attesting Officer*

*Commissioner of Patents and Trademarks*